US007501640B2

(12) United States Patent
Larson

(10) Patent No.: US 7,501,640 B2
(45) Date of Patent: Mar. 10, 2009

(54) LOW ENERGY ELECTRON COOLING SYSTEM AND METHOD FOR INCREASING THE PHASE SPACE INTENSITY AND OVERALL INTENSITY OF LOW ENERGY ION BEAMS

(76) Inventor: Delbert J. Larson, 8800 Melissa Ct., Waxahachie, TX (US) 75167

( * ) Notice: Subject to any disclaimer, the term of this patent is extended or adjusted under 35 U.S.C. 154(b) by 63 days.

(21) Appl. No.: 11/678,583

(22) Filed: Feb. 24, 2007

(65) Prior Publication Data

US 2008/0203923 A1 Aug. 28, 2008

(51) Int. Cl.
*H01J 25/02* (2006.01)

(52) U.S. Cl. ..... 250/489; 250/423 R; 315/501

(58) Field of Classification Search ..... 250/251, 250/489, 423 R, 491.1; 313/293, 306, 307, 313/311; 315/500, 501
See application file for complete search history.

(56) References Cited

U.S. PATENT DOCUMENTS 2,694,151 A * 11/1954 Berry ..... 250/286
3,787,681 A * 1/1974 Brunnee et al. ..... 250/427
4,975,572 A * 12/1990 Rempt ..... 250/251
5,001,438 A * 3/1991 Miyata et al. ..... 315/503
5,138,271 A * 8/1992 Ikegami ..... 315/501
5,854,531 A * 12/1998 Young et al. ..... 313/362.1

* cited by examiner

*Primary Examiner*—David Hung Vu
(74) *Attorney, Agent, or Firm*—Wilson Daniel Swayze, Jr.

(57) ABSTRACT

A low energy electron cooling system and method for increasing the phase space intensity and overall intensity of low energy ion beams, including a vacuum chamber to allow electron beam and ion beam merging and separation, a cathode to generate the electron beam, a collector to collect the electron beam, magnetic field generation devices to guide the electrons on their desired trajectories, and electrodes to accelerate and decelerate the electron beam. By overlapping the electron and ion beams, thermal energy is transferred from the ion beam to the electron beam, which allows an increase in the phase space density and overall density of the ion beams. Advantageously, the low energy electron cooling system uses electrodes to set up electrostatic potentials that trap non-beam neutralizing-background-ions longitudinally within the electron cooling region and solenoidal fields that trap the non-beam neutralizing-background-ions radially within the electron cooling region. The trapped non-beam neutralizing-background-ions allow electron cooling currents that are vastly larger than the space charge limit of previous electron cooling devices, which leads to vastly improved functioning of the electron cooling device over previous electron cooling devices.

16 Claims, 3 Drawing Sheets

LOW ENERGY ELECTRON COOLING SYSTEM AND METHOD FOR INCREASING THE PHASE SPACE INTENSITY AND OVERALL INTENSITY OF LOW ENERGY ION BEAMS

REFERENCES CITED [REFERENCED BY]

The following references are incorporated by reference in their entirety.

U.S. Patent Documents
U.S. Pat. No. 5,854,531 December 1999 Young, et al.
U.S. Pat. No. 5,138,271 August 1992 Ikegami
U.S. Pat. No. 5,001,438 March 1991 Miyata et al.
U.S. Pat. No. 4,867,939 Sep. 19, 1989 Deutch Other Documents
G. I. Budker, The 1966 Proc. Int. Symp. Electron and Positron Storage Rings, Saclay, Atomnaya Energiya vol. 22 p. 346, 1967.
L. Spitzer, "Physics of Fully Ionized Gases", (New York: Interscience, 1956) pp. 80-81.
G. I. Budker, et al., Particle Accelerators, Vol. 7, 197-211 (1976).
M. Bell, et al., Physics Letters, Vol. 87B, No. 3, (1979).
T. Ellison, et al., IEEE Trans. Nuc. Sci., Vol. NS-30, No. 4, 2636-2638, (1983).
D. J. Larson, et al., "Operation of a prototype intermediate-energy electron cooler", NIM, A311, 30-33 (1992).

FIELD OF THE INVENTION

The present invention relates to particle beam physics devices, more particularly, to a method and system of increasing the phase space intensity and overall intensity of very low energy ion beams by overlapping a properly formed electron beam on the ion beam.

BACKGROUND OF THE INVENTION

Electron cooling is a central technology to the invention proposed herein. Electron cooling was originally proposed by Budker in 1966. The basis for his proposal came from work done by Spitzer (1956) who showed that warm ions come to equilibrium with cooler electrons in a plasma. Due to the much larger mass of the ion, the final rms speed of the ions is much less than that of the electrons. Budker realized that an electron beam is simply a moving electron plasma. By superimposing an ion beam on a co-moving electron beam, warmer ions are cooled by the electron beam.

In the 1970's electron cooling was demonstrated to be an extremely good way of increasing the phase space density and stored lifetime of proton beams. Cooling times of between one and ten seconds were reported by experiments at Novosibirsk, CERN, and Fermilab. An experiment completed in Middleton, Wis. culminated in the construction of an electron cooler capable of cooling intermediate energy (about 5 GeV) antiproton beams.

Uses of high intensity, low energy ion beams may include the generation of photons, neutrons and a variety of nuclear isotopes, with improved efficiency and yield. Neutrons, isotopes, or photons are used in numerous applications. Neutron applications include boron neutron capture therapy, neutron radiography, and particularly, neutron irradiation for explosive detection, contraband detection, corrosion detection, and other types of non-destructive analysis. Isotope applications include positron emission tomography (PET). Photon (or gamma ray) applications include photonuclear interrogation which has been proposed as another means of detecting contraband and explosives. Photonuclear interrogation is also used for medical imaging and other nondestructive analysis of a wide range of materials.

Uses of high intensity, low energy ion beams may also include the production of energy through fusion interactions. Several nuclear reactions are known to produce much more energy than the energy required to initiate the interaction, and the initiation energy is very low by particle beam standards.

Conventional techniques in electron cooling use an electron beam and superimpose that electron beam onto the ion beam. Particle collisions between the two beams result in ion beam imperfections being transferred to the electron beam. The electron beam is then separated from the ion beam, and the electron beam is then collected in a collection device. Conventional techniques involve a direct acceleration of the electron beam from its source at a cathode, using electrodes biased positively with respect to the cathode and arranged so as to accelerate the electrons so that they have the same velocity as the ions. Typically, solenoidal and torroidal magnetic fields are used to guide the electron beam onto the ion beam, and then into the collection device. However, the conventional technique has serious difficulty for low energy situations. Conventional electron beams have an intensity that is limited by the electron beam's self space charge, and this limit is severe for low energy electron beams.

Accordingly, there is a need for an improved method and system for generating electron beams that will overcome the intensity limit of conventional techniques.

SUMMARY OF THE INVENTION

The present invention, which addresses the above desires and provides various advantages, resides in a method and system for generating high current electron beams that overcome the beam-current limit presented by the beam's self space charge. The system includes an electron cathode source, electrodes to accelerate the beams away from the cathode, a downstream electrode to decelerate the electrons to the desired low velocity, solenoidal and torroidal magnetic fields to guide the beam onto and off of a co-moving particle beam, and downstream electrodes including an electron beam collector to collect the electrons after the cooling is completed.

Distinctly, the present invention employs a cathode-side electrode biased positively with respect to the final cathode-side electrode and also employs a collector-side electrode biased positively with respect to the initial collector-side electrode. (Optionally, additional electrodes can be used on the cathode-side and collector-side as well. The final cathode-side electrode and initial collector-side electrode are each biased at the potential of the overlap region of the vacuum chamber within which the electron beam and ion beam overlap.) The presence of electrodes biased in this way enables an electric field which results in a force on the electrons that is directed away from the region where the beams overlap. Since the force on positively charged ions is in the opposite direction as the force on negatively charged electrons, the positively charged (non-beam) neutralizing-background-ions will be trapped longitudinally within the overlap region. The neutralizing-background-ions will also be trapped transversely by the solenoidal and torroidal magnetic guide fields. Hence, the neutralizing-background-ions are effectively trapped within the region that the electron and ion beams overlap. Since the trapped neutralizing-background-ions have positive charge, while the electrons have negative charge, the presence of the trapped neutralizing-background-ions will substantially offset the electron beam self space charge, enabling substantially larger currents in the electron beam.

The electron cooling system includes an electron injector which injects an electron beam into the storage ring, onto the path of a particle beam, and an electron collector which captures the electron beam. The electrons are injected with a predetermined amount of energy to cause the particles in the particle beam to move at an ideal velocity. By traveling and interacting with the particle beam, the electron beam maintains the particle beam within parameters that optimizes end-product production. Any heating, scattering and even deceleration that would otherwise adversely affect the particles in the particle beam is effectively compensated for by the electron beam. Accordingly, scattering and energy loss in the particle beam is substantially continuously compensated for before significant instabilities have an opportunity to develop. In this manner, events that would typically cause significant instabilities in the particle beam are minimized if not eliminated.

Since the effectiveness of the correction of particle beam errors is proportional to the electron current in the overlapping electron beam, the present invention will result in a large improvement in the achievable intensity and beam quality of low energy particle beams. By enabling higher intensity and beam quality of low energy particle beams, the present invention will also lead to improvement in the yields of photons, neutrons, nuclear isotopes and fusion energy produced by the low energy particle beams.

Other features and advantages of the present invention will become apparent from the following detailed description of the preferred embodiments, taken in conjunction with the accompanying drawings, which illustrate by way of example the principles of the invention.

BRIEF DESCRIPTION OF THE DRAWINGS

The invention is explained in more detail below with reference to the accompanying drawings in which.

DESCRIPTION OF THE PREFERRED EMBODIMENTS

Figure 1:
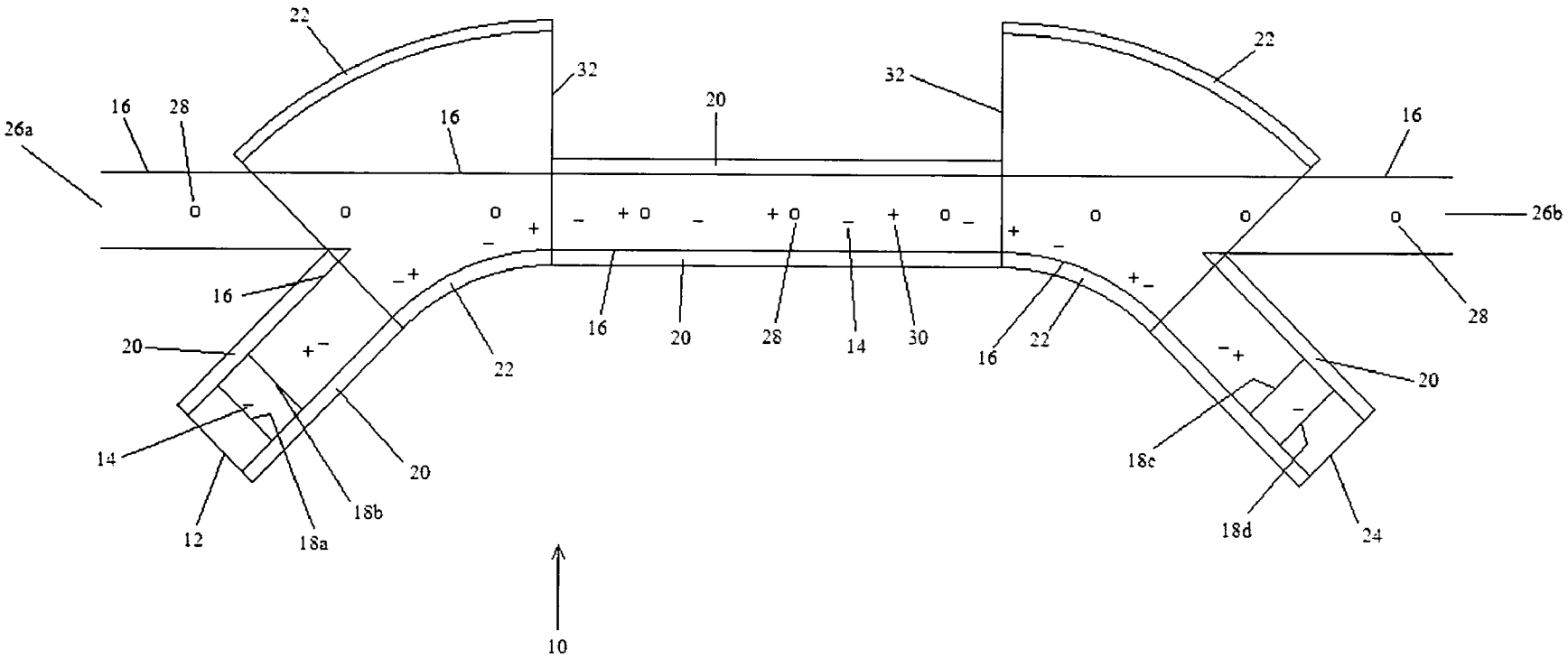
FIG. 1 is a schematic view of a system for use in the invention.

An electron cooling system 10 for increasing the phase space intensity and overall intensity of low energy particle beams is shown in FIG. 1. The electron cooling system 10 utilizes a combination of elements, including the electron supply device such as an electron cathode 12 for supplying a beam of electrons 14, a vacuum chamber 16 for containing particles, electrodes 18 to provide electric fields to accelerate or decelerate the electron beam and which serve to trap neutralizing-background-ions, solenoidal 20 and torroidal 22 wire windings to provide guiding and containing magnetic fields, an electron collector including a collection plate 24 having a material surface to collect the electrons 14 after they have performed their function, and ports 26 to allow beam particles 28 to enter and leave the electron cooling system 10. Positive neutralizing-background-ions 30, trapped by the fields of the electrodes 18, solenoids 20, and torroids 32 are also shown in FIG. 1.

Figure 2:
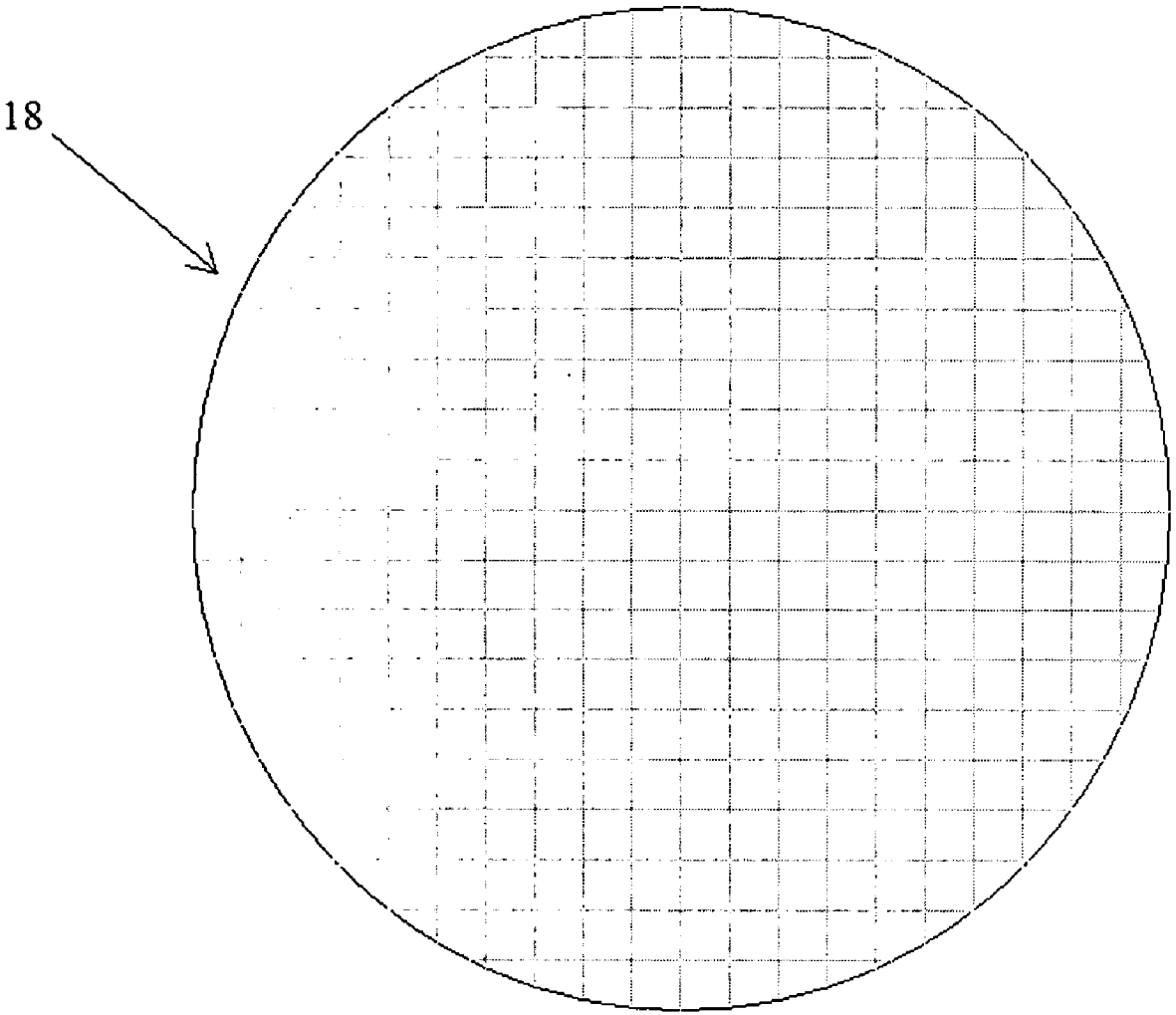
FIG. 2 is a schematic view of an electrode involving a grid structure.
Figure 3:
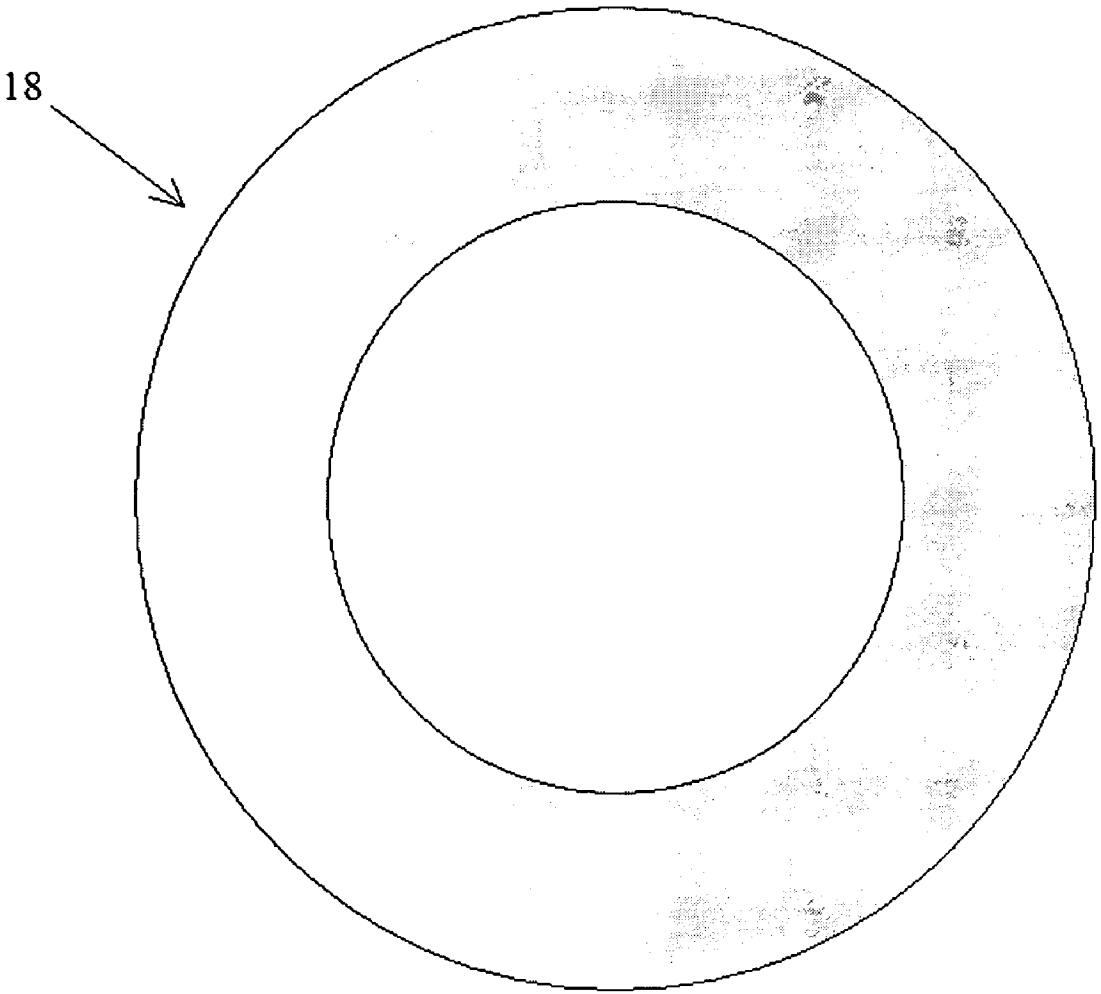
FIG. 3 is a schematic view of an electrode involving an annular structure.

The electrodes 18 will be a conducting structure with a substantially central opening. The substantially central opening can be achieved by a grid structure as shown in FIG. 2 or by an annular structure as shown in FIG. 3.

The electron cathode 12 can be made of off the shelf materials standard for contemporary electron sources. The cathode 12 is essentially a hot surface from which electrons 14 are freed. By placing an electrode 18*a* in front of the cathode 12 an electric field is generated. The magnitude of the electric field is given by the expression:

$$E=V/x \tag{1}$$

In equation (1), V is the potential difference between the cathode 12 and the electrode 18*a* and x is the distance between the electrode 18*a* and the cathode 12.

The amount of electron 14 beam current that is generated by an electron system comprised of an electron cathode 12 and a first electrode 18*a* is determined by the expression $$I=PV^{3/2} \tag{2}$$

In equation (2), V is the potential difference between the cathode 12 and the first electrode 18*a* and P is a constant, called the perveance, of the particular geometry employed in the system.

A First Preferred Embodiment—Case One

A first preferred embodiment could involve a cathode 12 with a 30.0 cm radius and a first electrode 18*a* positioned 4.0 mm downstream from the cathode 12. For the first preferred embodiment a grid electrode structure shown in FIG. 2 may be employed for the first electrode 18*a*. By using an 8.0 kV potential difference between the first electrode 18*a* and the cathode 12 an electron 14 beam current of approximately 10,000 A results. Hence, the perveance of the first preferred embodiment is $P=1.40\times10^{-2}$ $A/V^{3/2}$.

Desired end uses for the first preferred embodiment include the cooling of particle 28 beams stored in a colliding beam dual storage ring system. Such a dual storage ring system can produce energy by way of fusion reactions and be used as a fusion energy power source.

Characteristically, the particle 28 beams used in fusion reactions will have an energy of between 20.0 keV and 5.0 MeV and the particles 28 used will be deuterium, tritium, and He-3. As a specific preferred embodiment, the deuterium particle 28 velocity can be chosen as 247.2 keV and the tritium particle 28 velocity chosen as 167.5 keV. For electron cooling to function, the velocity of the electron 14 beam must be equal to the velocity of the particle 28 beam, and for the case of a 247.2 keV deuterium particle 28 beam this means that the electron 14 beam has an energy of 67.3 eV. For the case of a 167.5 keV tritium particle 28 beam this means that the electron 14 beam has an energy of 30.5 eV.

Consider first the case of a cooler for the tritium particles with an electron beam energy of 30.5 eV. In order to achieve an electron beam energy of 30.5 eV and still obtain a beam current of 10,000 A from a 30.0 cm radius cathode, conventional electron cooling systems would have to place an electrode approximately 15.0 microns away from the cathode and use an electrode to cathode potential difference of 30.5 V.

Advantageously, the present invention employs a first electrode 18*a* at larger distance (4.0 mm rather than 15.0 microns) and with a greater potential difference between the cathode 12 and first electrode 18*a* (8.0 kV instead of 30.5 V), in each case making it easier to achieve needed tolerances. In the first preferred embodiment, case one, the first electrode 18*a* could be a grid structure (FIG. 2) made up of a circular metal support structure with wires running across the aperture.

While easing the ability to achieve required tolerances is one advantage of the invention, an even more important advantage arises in the electron 14 currents allowed. The time required to cool particle 28 beams is given by the following expression:

$$\tau_{cool}=1/K_{in}=v_{emax}^{3}Ca^{2}e\beta_{beam}/4\Pi L_{cool}c^{3}r_{e}r_{i}\ln(B). \quad (3)$$

The important issue concerning the above expression is that the cooling time is inversely proportional to I, which is the electron 14 beam current.

Without some apparatus to neutralize the charge of particle 28 beams, the potential difference between the beam center and the beam edge is given by the following expression:

$$V=30I/\beta \quad (4)$$

In the above expression, I is the current of the particle 28 beam and β is the velocity of the beam particles 28 divided by the speed of light. For the case considered here I is 10,000 A and β is 0.0107, leading to a beam center to beam edge potential difference of over 28 million volts. Clearly such a large current can not be sustained, since the beam energy has been specified to be only 30.5 eV. Indeed, were the current to be limited by its own self space charge, the limit would be I=0.0109 A, which is about one million times less than the desired value of 10,000 A. Even more constraining is the condition of the energy spread within the beam. For electron cooling to work, the electron 14 energies should all be in a range of values, typically 1% or less of the central particle 28 beam energy. A space charge potential of 0.3 V, leading to an electron 14 beam energy spread of 1% of the 30.5 eV main electron 14 beam energy, would limit the useful electron cooling current to 0.1 milliamps, 100 million times less than the desired current.

Significantly, the proposed invention uses a second electrode 18*b* prior to electron 14 beam entry into the torroid 32 that is at the desired potential difference from the cathode 12, while also employing the first electrode 18*a* prior to the second electrode 18*b*, where the first electrode 18*a* is at a more positive potential than the second electrode 18*b* resulting in an electric field that decelerates the electrons 14 just before they enter the torroid 32. This same electric field will cause any positive neutralizing-background-ions 30 present in the system to be reflected back into the cooling region. If the spacing of the wires is 400 microns, a good estimate of the self space charge depression is given by use of Gauss's Law $\int\epsilon_0 E(dA)=q_{in}$. Within a sphere of charge this becomes $\epsilon_0 E4\pi r^2=(4/3)\pi r^3\rho$, or, $E=(\rho/3\epsilon_0)r$, and the self potential is $V=\int Edr=(\rho/6\epsilon_0)r^2$. With $\epsilon_{0=8.85\times10^{-12}}$ $C^2/Nm^2$, and r=0.2 mm this leaves a self potential of $V=(0.0108\ C/m^3)(2\times10^{-4}\ m)^2/6(8.85\times10^{-12}\ C^2/Nm^2)=8.14$ V. This is a reasonable upper limit, and hence the wire spacing should be about 400 microns within the cathode-side second electrode 18*b*. (Since the first electrode 18*a* is at a higher potential, the wire spacing within the grid can be larger for the first electrode 18*a*.)

The positive neutralizing-background-ions 30 will be formed as the electron 14 beam traverses the system as a result of collisions between the electrons 14 and neutral gas particles present inside of the vacuum chamber 16. The positive neutralizing-background-ions 30 will be formed with an energy of about $1/40^{th}$ of an eV, which is the energy of typical room temperature gases and the positive neutralizing-background-ions 30 will therefore be trapped radially by the torroidal and solenoidal fields. The positive neutralizing-background-ions 30 will execute an approximate helical motion around the magnetic field lines with the radius of the helix given by the following expression:

$$r=mv/eB \quad (5)$$

In equation (5) m is the mass of the positive neutralizing-background-ion 30, e is the charge on the positive neutralizing-background-ion 30, B is the magnetic field of the solenoid or torroid 32, and v the velocity of the positive neutralizing-background-ion 30 perpendicular to the magnetic field. For the case of a carbon atom with an energy of $1/40^{th}$ of an eV, equation (5) results in an expected radius of the helical motion of about 7.91 mm.

On the collector-side, the proposed invention uses a third electrode 18*c* just after electron 14 beam exit from the torroid 32 that is at the desired potential difference from the cathode 12, while also employing a fourth electrode 18*d* downstream from the third electrode 18*c*, where the third electrode 18*c* is at a less positive potential than the fourth electrode 18*d* resulting in an electric field that accelerates the electrons 14 just after they leave the torroid 32. This same electric field will cause any positive neutralizing-background-ions 30 present in the system to be reflected back into the overlap region. (The overlap region is the region where the particle beam and electron beam are overlapped.)

Therefore, the positive neutralizing-background-ions 30 will be trapped radially by the solenoidal and torroidal fields produced by the solenoidal 20 and torroidal 22 windings, and the positive neutralizing-background-ions 30 will be trapped longitudinally by the electric fields produced by the electrodes 18*a*, 18*b*, 18*c* and 18*d*. The combination of longitudinal and radial trapping means that the positive neutralizing-background-ions 30 are fully trapped within the cooling region. The build up of the positive neutralizing-background-ions 30 will continue until the electron 14 beam is essentially neutralized, allowing for electron 14 currents that vastly exceed the conventional limit given by equation (4).

A First Preferred Embodiment—Case Two

For case two of the first preferred embodiment, one difference from the first preferred embodiment, case one is the potential difference between the cathode 12 and the electrodes 18*b* and 18*c* that are nearest to the torroids 32. In the first preferred embodiment, case two this potential difference is 67.3 V rather than the 30.5 V specified in the first preferred embodiment, case one. The analysis changes only slightly, in that the benefit from the invention is fifty million times more achievable current rather than the 100 million times calculated for the first preferred embodiment case one.

A First Preferred Embodiment—General Case

For the general case of the first preferred embodiment, the potential difference between the cathode 12 and the electrodes 18*b* and 18*c* that are nearest to the torroids 32 can be anywhere in a range between 1.5 V and 840 V. This range comes from the range over which fusion cross sections are highest. The lowest energy of the desired fusion energy range is 20 keV, which is about 20 times less than the energy considered in the First Preferred Embodiment, Cases One and Two. Hence, the lowest energy electron 14 beam will be 20 times less than the 30.5 eV used therein, or 1.5 eV. Since the charge on the electron 14 is e, the potential difference between the cathode 12 and the electrodes 18*b* and 18*c* is 1.5 V in this case. The highest energy of the desired fusion energy range is 5.0 MeV, which is about 12.5 times larger than the energy considered in the First Preferred Embodiment, Cases One and Two. Hence, the largest energy electron 14 beam will be 12.5 times more than the 67.3 eV used therein, or 840 eV. Since the charge on the electron 14 is e, the potential difference between the cathode 12 and the electrodes 18*b* and 18*c* is 840 V in this case.

A Second Preferred Embodiment—Case One

A second preferred embodiment, case one, could involve a cathode 12 with a one cm radius and a first electrode 18*a* positioned one cm downstream from the cathode 12. For the second preferred embodiment, case one an annular electrode structure shown in FIG. 3 may be employed. By using a 10 kV potential difference between the first electrode 18*a* and the cathode 12 an electron 14 beam current of approximately 3.96 A results. Hence, the perveance of the second preferred embodiment is $P=3.96\times10^{-6}$ A/$V^{3/2}$.

Desired end uses for the second preferred embodiment include the cooling of particle 28 beams stored in storage rings. Such storage rings can produce neutrons, isotopes, or photons which can then be used in numerous applications. Neutron applications include boron neutron capture therapy, neutron radiography, and particularly, neutron irradiation for explosive detection, contraband detection, corrosion detection, and other types of non-destructive analysis. Isotope applications include positron emission tomography (PET). Photon (or gamma ray) applications include photonuclear interrogation which has been proposed as another means of detecting contraband and explosives. Photonuclear interrogation is also used for medical imaging and other nondestructive analysis of a wide range of materials.

Characteristically, the particle 28 beams used in storage rings for the production of neutrons will have an energy of around 3.2 MeV and the particle 28 used will be deuterium. For electron cooling to function, the velocity of the electron 14 beam must be equal to the velocity of the particle 28 beam, and for the case of a 3.2 MeV deuterium particle 28 beam this means that the electron 14 beam has an energy of 872 eV, with a desired electron 14 cooling beam current of one Ampere.

In order to achieve an electron 14 beam energy of 872.0 eV and still obtain a beam current of one Ampere from a one cm radius cathode 12, conventional electron cooling systems would have to place an electrode 0.872 millimeters away from the cathode 12 and use a first electrode 18*a* to cathode 12 potential difference of 872.0 V. Advantageously, the present invention employs a first electrode 18*a* at larger distance (10.0 mm rather than 872 microns) and with a greater potential difference between the cathode 12 and first electrode 18*a* (10.0 kV instead of 872 V), in each case making it easier to achieve needed tolerances. The invention also allows the use of an annular electrode (FIG. 3) rather than a grid electrode (FIG. 2) to be used as the first electrode 18*a*, although a grid electrode (FIG. 2) could also be used in this embodiment as well. (The radius of the hole in an annular electrode should be about equal to or less than the separation between the first electrode 18*a* and the cathode 12. For example, with a 872 micron separation, a one cm hole size would lead to undesired non-uniform electric fields.)

While easing the ability to achieve required tolerances is one advantage of the invention, an even more important advantage arises in the electron 14 currents allowed. The time required to cool particle 28 beams is given by equation (3):

$$\tau_{cool}=1/K_{in}=v_{emax}{}^{3}Ca^{2}e\beta_{beam}/4IL_{cool}c^{3}r_{e}r_{i}\ln(B). \quad (3)$$

The important issue concerning equation (3) is that the cooling time is inversely proportional to I, which is the electron 14 beam current.

Without some means to neutralize the charge of particle 28 beams, the potential difference between the beam center and the beam edge is given by the following expression:

$$V=30I/\beta \quad (4)$$

In the above expression, I is the current of the particle 28 beam and β is the velocity of the beam particles 28 divided by the speed of light. For the case considered here I is 1.0 A and β is 0.0584, leading to a beam center to beam edge potential difference of 513 Volts. For electron cooling to work, the electron 14 energies should all be in a range of values, typically 1% or less of the central electron 14 beam energy, which for the second preferred embodiment, case one is 1% or less of 872 V, or 8.72 V. A space charge potential of 8.72 V would limit the useful electron 14 cooling current to 17.0 milliamps, 1.7% of the desired current.

Significantly, the proposed invention uses a second electrode 18*b* prior to electron 14 beam entry into the torroid 32 that is at the desired potential difference from the cathode 12, while also employing the first electrode 18*a* prior to the second electrode 18*b*, where the potential on the first electrode 18*a* is more positive than the potential on the second electrode 18*b* resulting in an electric field that decelerates the electrons 14 just before they enter the torroid 32. This same electric field will cause any positive neutralizing-background-ions 30 present in the system to be reflected back into the cooling region.

The positive neutralizing-background-ions 30 will be formed as the electron 14 beam traverses the system as a result of collisions between the electrons 14 and neutral gas particles present inside of the vacuum chamber 16. The positive neutralizing-background-ions 30 will be formed with an energy of about $1/40^{th}$ of an eV, which is the energy of typical room temperature gases and the positive neutralizing-background-ions 30 will therefore be trapped radially by the torroidal and solenoidal fields. The positive neutralizing-background-ions 30 will execute a helical motion around the magnetic field lines with the radius of the helix given by the following expression:

$$r=mv/eB \quad (5)$$

In equation (5) m is the mass of the neutralizing-background-ion 30, e is the charge on the neutralizing-background-ion 30, B is the magnetic field of the solenoid or torroid 32, and v the velocity of the neutralizing-background-ion 30 perpendicular to the magnetic field. For the case of a carbon atom with an energy of $1/40^{th}$ of an eV, equation (5) results in an expected radius of the helical motion of about 7.91 mm.

On the collector-side, the proposed invention uses a third electrode 18*c* just after electron 14 beam exit from the torroid 32 that is at the desired potential difference from the cathode 12, while also employing a fourth electrode 18*d* after the third electrode 18*c*, where the third electrode 18*c* is at a less positive potential than the fourth electrode 18*d* resulting in an electric field that accelerates the electrons 14 just after they leave the torroid 32. This same electric field will cause any positive neutralizing-background-ions 30 present in the system to be reflected back into the overlap region. (The overlap region is the region where the particle beam and electron beam are overlapped.)

Therefore, the positive neutralizing-background-ions 30 will be trapped radially by the solenoidal and torroidal fields produced by the solenoidal 20 and torroidal 22 windings, and the positive neutralizing-background-ions 30 will be trapped longitudinally by the electric fields produced by the electrodes 18*a*, 18*b*, 18*c* and 18*d*. The combination of longitudinal and radial trapping means that the positive neutralizing-background-ions 30 are fully trapped within the cooling region. The build up of the positive neutralizing-background-ions 30 will continue until the electron 14 beam is essentially neutralized, allowing for electron 14 currents that vastly exceed the conventional limit given by equation (4).

A Second Preferred Embodiment—Case Two

For case two of the second preferred embodiment, the desired particle 28 beam may be protons with an energy of 1.75 MeV. In this case, in order to match the particle 28 beam velocity with the electron 14 beam velocity, the electron 14 beam energy must be 953 eV, which can be arranged with a 953 V potential difference between the cathode 12 and the electrodes 18*b* and 18*c* that are nearest to the torroids 32.

A Second Preferred Embodiment—General Case

For the general case of the second preferred embodiment, the desired particle 28 beam may be any low energy ion beam, and the electron 14 beam energy can lie between a few volts and about 10 kV. (Once the electron 14 beam energy reaches 10 kV, the space charge depression of a one Ampere beam is only 150 V, or 1.5% of the central electron 14 beam energy. At this energy and above, one ampere electron 14 beams can be generated without the present invention. The present invention will still allow greater beam currents in such embodiments, but the advantage is less for higher energy embodiments.)

Other Embodiments

The above sections have described the preferred embodiments of the invention. It should be noted here that other embodiments would include electrodes that have different geometries for allowing beam passage, such as square or rectangular or irregularly cut holes within a solid metal plate to replace the structure shown in FIG. 3. Another embodiment could include irregularly spaced grid wires or parallel wires only to replace the grid structure shown in FIG. 2. The central invention within this patent application are electrodes 18*a* and 18*d* that are biased at a positive potential with respect to the overlap region of the vacuum chamber that surrounds the overlapping beams, not the specific shape of the electrodes.

Further, it is possible that the collection plate 24 itself could be used as the fourth electrode 18*d*, since the collection plate 24 could be biased positively with respect to the vacuum chamber surround the overlapping beams to provide the necessary fields to trap the neutralizing-background-ions 30. This would usually be undesirable, since employing a separate fourth electrode 18*d* along with additional collector-side electrodes allows energy recovery from the electron 14 beam, and biasing the collection plate 24 even more positively than the vacuum chamber surrounding the overlapping beams would result in an even more energetic beam impinging upon the collection plate 24, but it would serve as one end of a longitudinal trap for the neutralizing-background-ions 30. (Using electrodes in the collector to allow energy recovery from the electron 14 beam is already well known, and is the more preferred approach.)

What is claimed is:

1. An electron beam and particle beam system including an electron beam, a particle beam and neutralizing-background-ions, comprising:

a vacuum chamber to allow passage, merging and separation of said electron beam and said particle beam including an overlap region wherein said electron beam and said particle beam are overlapped;

an electron supply device including a cathode to produce said electron beam;

an electron collector including a collection plate to collect said electron beam;

a first electrode located downstream from said cathode biased at a positive potential with respect to said cathode in order to accelerate said electron beam;

a second electrode located downstream from said first electrode and upstream from said overlap region and biased at a less positive potential than said first electrode to provide a first end of a longitudinal electric potential trap for said neutralizing-background-ions;

a magnetic field production device to create magnetic fields to guide said electron beam along a desired path, merge and separate said electron beam and said particle beam, and to provide radial trapping for said neutralizing-background-ions;

a third electrode located downstream from said overlap region;

a fourth electrode located downstream from said third electrode and biased at a more positive potential than said third electrode to provide a second end of the longitudinal electric potential trap for said neutralizing-background-ions.

2. A system in accordance with claim 1, wherein at least one of the first electrode, the second electrode, the third electrode or the fourth electrode includes a substantially central opening to allow passage of said electron beam.

3. A system in accordance with claim 1, wherein at least one of the first electrode, the second electrode, the third electrode or the fourth electrode includes a grid conducting structure to allow passage of said electron beam.

4. A system in accordance with claim 1, wherein at least one of the first electrode, the second electrode, the third electrode or the fourth electrode includes a circular hole cut in it to allow passage of said electron beam.

5. A system in accordance with claim 1, wherein said fourth electrode is said collection plate.

6. A system in accordance with claim 1, wherein said magnetic field production device includes solenoidal and toroidal wire windings with electric current flowing through the wires.

7. A system in accordance with claim 1, wherein said magnetic field production device includes permanent magnet material.

8. A system in accordance with claim 1, wherein said magnetic field production device includes solenoidal and toroidal wire windings with electric current flowing through the wires and permanent magnet material.

9. A method of cooling a low energy particle beam with an electron beam while containing neutralizing-background-ions, comprising the steps of:

operating a vacuum chamber to allow passage, merging and separation of said electron beam and said particle beam including an overlap region wherein said electron beam and said particle beam are overlapped;

operating an electron supply device including a cathode to produce said electron beam;

operating an electron collector including a collection plate to collect said electron beam;

operating a first electrode located downstream from said cathode biased at a positive potential with respect to said cathode in order to accelerate said electron beam;

operating a second electrode located downstream from said first electrode and upstream from said overlap region and biased at a less positive potential than said first electrode to provide a first end of a longitudinal electric potential trap for said neutralizing-background-ions;

operating a magnetic field production device to create magnetic fields to guide said electron beam along a desired path, merge and separate said electron beam and said particle beam, and to provide radial trapping for said neutralizing-background-ions;

operating a third electrode located downstream from said overlap region;

operating a fourth electrode located downstream from said third electrode and biased at a more positive potential than said third electrode to provide a second end of the longitudinal electric potential trap for said neutralizing-background-ions.

10. A method in accordance with claim 9, wherein at least one of the first electrode, the second electrode, the third electrode or the fourth electrode includes a conducting structure with a substantially central opening to allow passage of said electron beam.

11. A method in accordance with claim 9, wherein at least one of the first electrode, the second electrode, the third electrode or the fourth electrode includes a grid conducting structure to allow passage of said electron beam.

12. A method in accordance with claim 9, wherein at least one of the first electrode, the second electrode, the third electrode or the fourth electrode includes a circular hole cut in it to allow passage of said electron beam.

13. A method in accordance with claim 9, wherein said fourth electrode is said collection plate.

14. A method in accordance with claim 9, wherein said magnetic field production device includes solenoidal and toroidal wire windings with electric current flowing through the wires.

15. A method in accordance with claim 9, wherein said magnetic field production device includes permanent magnet material.

16. A method in accordance with claim 9, wherein said magnetic field production device includes solenoidal and toroidal wire windings with electric current flowing through the wires and permanent magnet material.

* * * * *